US007150385B1

(12) United States Patent
Wen

(10) Patent No.: US 7,150,385 B1
(45) Date of Patent: Dec. 19, 2006

(54) BRAKING MECHANISM FOR NAIL DRIVER

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/284,965

(22) Filed: Nov. 23, 2005

(51) Int. Cl.
*B25C 1/04* (2006.01)

(52) U.S. Cl. ..... 227/8; 227/120

(58) Field of Classification Search ..... 227/120, 227/8, 136, 156
See application file for complete search history.

(56) References Cited

U.S. PATENT DOCUMENTS 6,056,181 A * 5/2000 Chuang ..... 227/8
6,149,046 A * 11/2000 Ho et al. ..... 227/8
6,199,739 B1 * 3/2001 Mukoyama et al. ..... 227/8
6,264,085 B1 * 7/2001 Ho et al. ..... 227/8
6,708,860 B1 * 3/2004 Thieleke ..... 227/8
6,913,179 B1 * 7/2005 Chen ..... 227/8
6,966,477 B1 * 11/2005 Chien-Kuo et al. ..... 227/8
7,028,875 B1 * 4/2006 Beville et al. ..... 227/8
7,032,794 B1 * 4/2006 Hung et al. ..... 227/8
7,086,573 B1 * 8/2006 Wen ..... 227/8

* cited by examiner

*Primary Examiner*—Scott A. Smith

(57) ABSTRACT

A nail driver includes a cell formed inside a nail cartridge. A braking unit with one end formed as a retaining portion and the other end formed as a contact portion is pivotally installed in the cell. A resilient member is installed in the cell for pressing on the contact portion to swing the retaining portion to a releasing position so that a securing slide rod can freely slide to have the nail drive being actuated when there is any nail in the nail cartridge. When there is no more nail, a nail pusher pushed by a spring makes a protrusion of the nail pusher pressing on the contact portion against the resilient member to swing the retaining portion to a restraining position to block in the moving path of an extending portion of the securing slide so that the nail drive cannot be actuated until the nails are reloaded.

8 Claims, 3 Drawing Sheets

BRAKING MECHANISM FOR NAIL DRIVER

BACKGROUND OF THE INVENTION

The present invention relates to a braking mechanism for a nail driver, more particularly to a braking mechanism to restrain the movement of a securing slide rod when a nail driver runs out of nails.

A braking mechanism for a nail driver is to invalidate the trigger of the nail driver when the nail cartridge is empty, so that the user is reminded of reloading the nails.

Conventionally, a braking mechanism for the nail driver includes a nail pusher formed with a protrusion to press a stopper installed on a nail cartridge so that the stopper can restrain the movement of the securing slide rod when no more nail exists in the nail cartridge.

However, the conventional stopper cannot provide secure restrain so that the securing slide rod is easily released to cause failure of the braking mechanism. Moreover, after the nails are reloaded in the cartridge, the conventional braking mechanism utilizes a leaf spring to push back the stopper. However, the leaf spring may fail to provide enough resilient force because of the structure itself or a fatigue after using in several times. On the other hand, the conventional leaf spring is exposed outside so that it is not easy to prevent from the contamination.

Therefore, the convention braking mechanism exists drawbacks to be improved.

BRIEF SUMMARY OF THE INVENTION

The present invention is to provide a reliable braking mechanism for a nail driver so that a securing slide rod can be securely restrained to ensure the nail driver will not be actuated when the nail driver runs out of nails.

Accordingly, a nail driver of the present invention includes a guiding plate, a securing slide rod, a nail cartridge and a braking unit. The guiding plate has a punch channel on one surface. The securing slide rod has an extending portion and is sildably attached on the other surface of the guiding plate. The nail cartridge is mounted to the guiding plate at the surface with the punch channel. The nail cartridge has an inner space for installing a nail pusher with a protrusion and at least one spring for pushing the nail pusher to press nails loaded in the nail cartridge toward the punch channel, and a cell connected to the inner space. The braking unit has one end formed as a retaining portion and the other end formed as a contact portion. The braking unit is pivotally installed in the cell so that the retaining portion will swing by exerting a force on the contact portion. A resilient member is installed in the cell for pressing on the contact portion to swing the retaining portion to a releasing position without blocking in a moving path of the extending portion so that the securing slide rod can freely slide to have the nail drive being actuated when there is any nail in the nail cartridge. When there is no more nail in the cartridge, the nail pusher pushed by the spring makes the protrusion pressing on the contact portion against the resilient member to swing the retaining portion to a restraining position to block in the moving path of the extending portion so that the securing slide rod can not freely slide to have the nail drive being actuated.

The present invention can provide a reliable braking mechanism because there is an orthogonal surface-to-surface contact between the retaining portion of the braking unit and the extending portion of the securing slide rod instead of line contact or partial surface contact in conventional braking mechanism. Moreover, the spiral spring is more reliable to provide enough resilient force to make the retaining portion back to the releasing position. Finally, the cell is formed inside the nail cartridge and the spiral spring installed in the cell can prevent from the contamination.

Various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
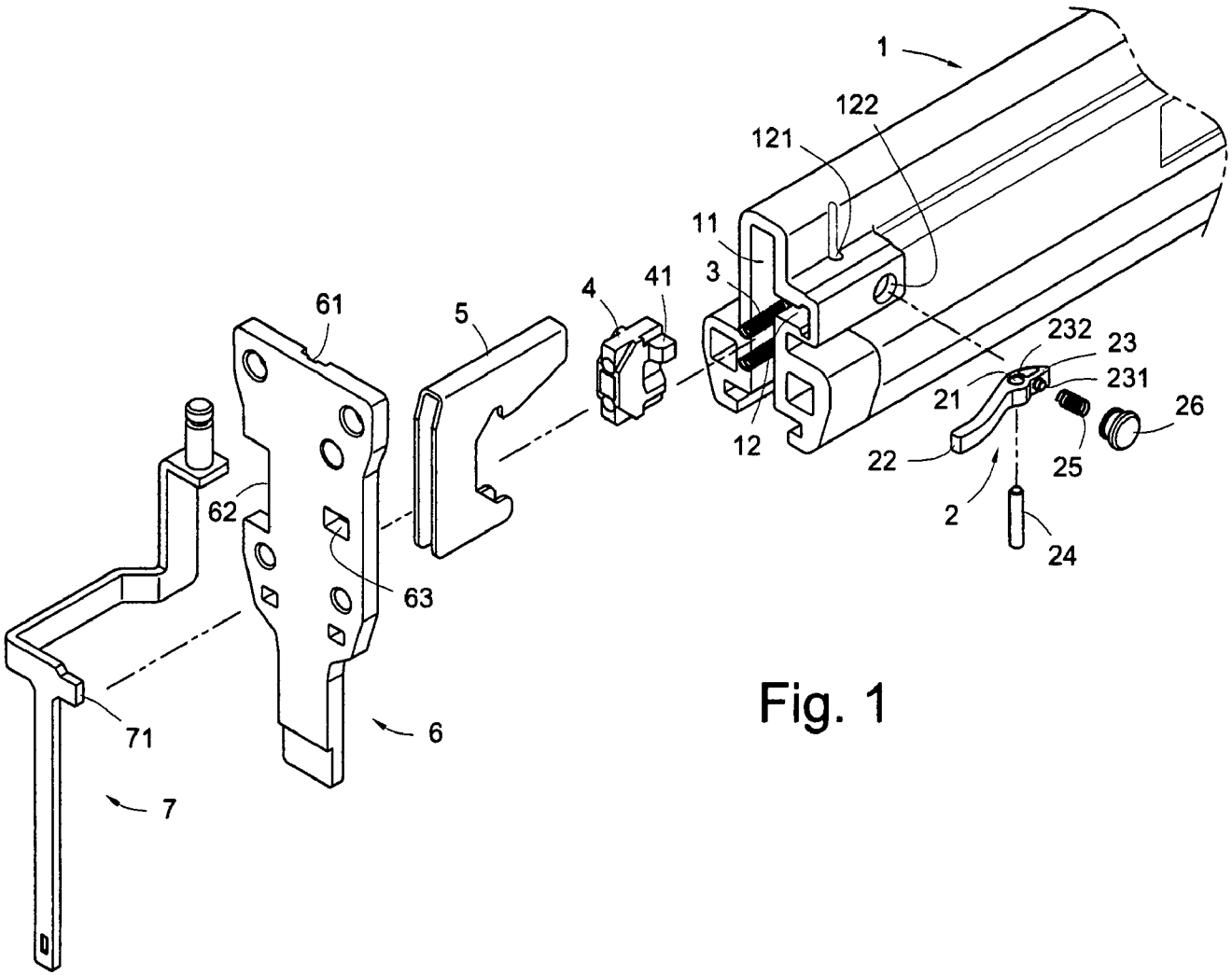
FIG. 1 is an exploded perspective view of a nail driver of the present invention.

Referring to FIG. 1, a nail driver of the present invention includes a guiding plate 6, a securing slide rod 7, a nail cartridge 1 and a braking unit 2.

The guiding plate 6 includes a punch channel 61 formed on one surface, a guiding portion 62 formed on one side and an opening 63 formed thereon.

Figure 2:
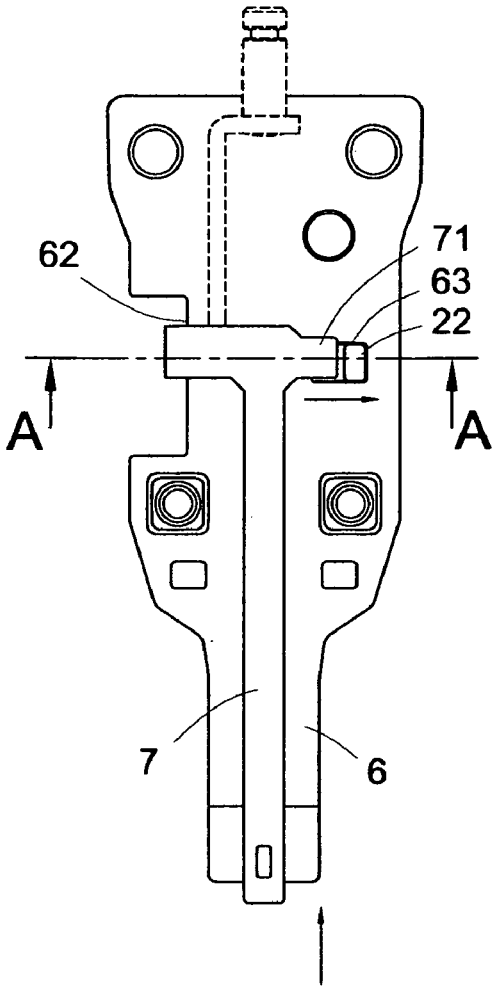
FIG. 2 is a side view of the nail driver, showing a securing slide rod capable of freely sliding upward and downward when there is a nail in a nail cartridge.

The securing slide rod 7 with the lower body attached to the other surface of the guiding plate 6 can slidably move within the guiding portion 62, so that a lower striking end of the securing slide rod 7 can move downward to press against a surface of a workpiece and an upper distal end of the securing slide rod 7 can raise upward to push on an inner trigger to control a trigger stem to actuate the nail driver. The securing slide rod 7 includes an extending portion 71 formed on the top of the lower body thereof. When the securing slide rod 7 slides, the extending portion 71 can pass above merely a portion of the opening 63 as shown in FIG. 2.

Figure 3:
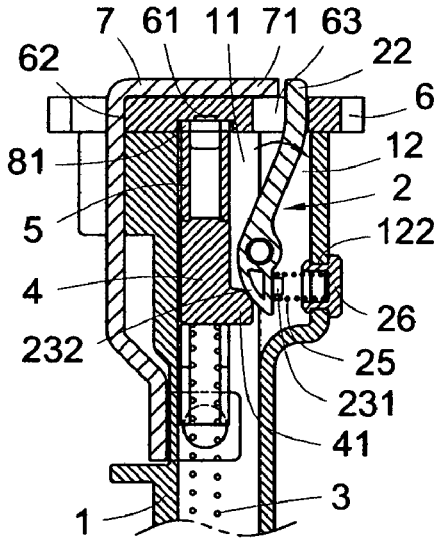
FIG. 3 is a cross sectional view along a line A—A of FIG. 2, showing that as the last nail existed in the nail cartridge, a protrusion just contacts on an end of a braking unit and the securing slide rod is free so that the nail driver can be actuated.

The nail cartridge 1 is mounted to the guiding plate 6 at the surface with the punch channel 61. The nail cartridge 1 has an inner space 11 for installing at least one spring 3 and a nail pusher 5 and a cell connected to the inner space 11. The nail pusher 5 includes a spring retainer 4 with a protrusion 41 formed thereon. The spring 3 presses on the spring retainer 4 to push the nail pusher 5 so that the nails 81 (as shown in FIG. 3) installed in the nail cartridge can be pushed by the nail pusher 5 toward the punch channel 61.

Furthermore, the cell 12 is located adjacent to the opening 63 of the guiding plate 6. Two hinge holes 121 are correspondingly formed on two opposite side walls of the cell 12, respectively. A bore 122 is formed on the top wall of the cell 12 and a plug 26 covers on the bore 122.

The braking unit 2 is installed inside the cell 12. A shaft 24 is used to pass through the pivot hole 232 formed on the braking unit 2. Two ends of the shaft 24 are then inserted in two hinge holes 121, respectively. The braking unit 2 has one end formed as a retaining portion 22 and the other end as a contact portion 23. The retaining portion 22 passes through the opening 63 to protrude out of the guiding plate 6. The contact portion 23 includes a pillar 231 formed on one side with respect to the bore 122 and a curved surface 232 formed on the other side. Moreover, a resilient element such as a spiral spring 25 is mounted to the pillar 231 with one end and the other end of the spiral spring 25 is received in the plug 26. Therefore, when a force exerts on the contact portion 23 against the spring force of the resilient element 25, the retaining portion 22 can swing from one side of the opening 63 to the other.

The mechanism for the braking unit 2 to restrain the movement of the securing slide rod 7 when the nail driver runs out of nails 81 is described as follows.

As shown in FIG. 3, when the last nail 81 still exists in the punch channel 61, the protrusion 41 of the nail pusher 5 just contacts on the curved surface 232 of the contact portion 23 of the braking unit 2. At this time, no other force except for the spring force of the resilient element 25 exerts on the contact portion 23; therefore, the retaining portion 22 of the braking unit 2 still stays at a releasing position against one side of the opening 63. That is, the retaining portion 22 is not located in a moving path of the extending portion 71 to restrain the movement of the securing slid rod 7, as shown in FIG. 2.

Figure 4:
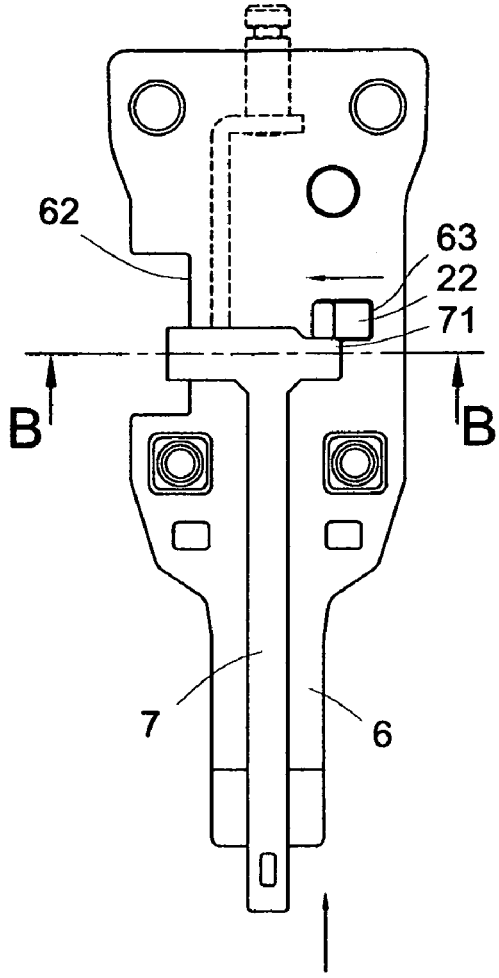
FIG. 4 is another side view of the nail driver, showing that a retaining portion stops the securing slide rod moving upward when there is no nail in the nail cartridge.
Figure 5:
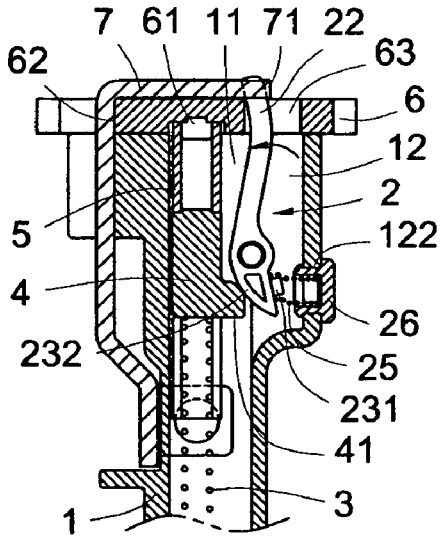
FIG. 5 is a cross sectional view along a line B—B of FIG. 4, showing no nail in the nail cartridge so that the protrusion presses the contact portion on a curved surface to swing the retaining portion securely stop the movement of the securing slide rod.

However, as shown in FIG. 5, when the last nail 81 is gone, the nail pusher 5 will move toward the punch channel 61 further so that the protrusion 41 will push the contact portion 23 on the curved surface 232. That is, the contact portion 23 of the braking unit 2 is pushed against the resilient element 25. Therefore, under the pivotal connection of the braking unit 2 in the cell 12 by the shaft 24, the retaining portion 22 of the braking unit 2 will swing to a restraining position against the other side of the opening 63. As shown in FIG. 4, at this restraining position, the retaining portion 22 will block in the moving path of the extending portion 71. Such that, as the securing slid rod 7 moves upward, an orthogonal surface-to-surface contact between the retaining portion 22 and the extending portion 71 is provided to ensure a secure restrain to stop the securing slid rod 7 moving upward any further. Therefore, the inner trigger cannot be pushed by the securing slid rod 7 any more. Even though the user presses on the trigger, the trigger stem will not be driven to actuate the nail driver. It will remind the user to reload the nails.

According to the above descriptions, the present invention can provide a reliable braking mechanism because there is an orthogonal surface-to-surface contact between the retaining portion 22 of the braking unit 2 and the extending portion 71 of the securing slide rod 7 instead of line contact or partial surface contact in conventional braking mechanism. Moreover, the spiral spring 25 is more reliable to provide enough resilient force to make the retaining portion 22 back to the releasing position. Finally, the cell 12 is formed inside the nail cartridge 1 and the spiral spring 25 installed in the cell 12 can prevent from the contamination.

The present invention is thus described. It will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nail driver, comprising:

a guiding plate including a punch channel;

a securing slide rod including an extending portion, capable of slidably moving with respect to the guiding plate;

a nail cartridge mounted to the guiding plate, having an inner space for including a nail pusher including a protrusion and at least one spring for pushing the nail pusher to press nails loaded in the nail cartridge toward the punch channel, and a cell connected to the inner space;

a braking unit including one end formed as a retaining portion and the other end formed as a contact portion, which is pivotally installed in the cell so that the retaining portion will swing by exerting a force on the contact portion; and a resilient member installed in the cell, for pressing on the contact portion to swing the retaining portion to a releasing position without blocking a moving path of the extending portion so that the securing slide rod can freely slide to allow the nail drive to be actuated when there is at least one nail in the nail cartridge, such that when no more nail in the cartridge, the nail pusher pushed by the at least one spring causes the protrusion to press the contact portion against the bias of the resilient member to swing the retaining portion to a restraining position to block the moving path of the extending portion so that the securing slide rod can not freely slide to have the nail drive to be actuated.

2. The nail driver as claimed in claim 1, wherein the nail cartridge includes a spring retainer wherein the spring presses on the spring retainer to push the nail pusher, and the protrusion is formed on the spring retainer.

3. The nail driver as claimed in claim 1, wherein the guiding plate further includes a guiding slot for the securing slide rod to slide therewithin.

4. The nail driver as claimed in claim 1, wherein the guiding plate further includes an opening for the retaining portion to pass through and swing therewithin.

5. The nail driver as claimed in claim 1, wherein the contact portion includes a curved surface for the protrusion to press thereon.

6. The nail driver as claimed in claim 1, wherein the resilient element is a spiral spring.

7. The nail driver as claimed in claim 1, wherein the contact portion includes a pillar and the resilient element is installed between the pillar and a top wall of the cell.

8. The nail driver as claimed in claim 1, wherein a bore is formed on a top wall of the cell, a plug covers the bore, and the resilient element is received in the plug to press the contact portion.

* * * * *